US006367212B1

(12) United States Patent
Manning

(10) Patent No.: US 6,367,212 B1
(45) Date of Patent: Apr. 9, 2002

(54) FIRE-RETARDANT ROOF CONSTRUCTION

(76) Inventor: Noel Christopher Manning, Maple Lodge, Kilmolin Road, Enniskerry, County Wicklow (IE)

( * ) Notice: Subject to any disclaimer, the term of this patent is extended or adjusted under 35 U.S.C. 154(b) by 0 days.

(21) Appl. No.: 09/462,131

(22) PCT Filed: Jun. 25, 1998

(86) PCT No.: PCT/IE98/00050

§ 371 Date: Dec. 30, 1999

§ 102(e) Date: Dec. 30, 1999

(87) PCT Pub. No.: WO99/01624

PCT Pub. Date: Jan. 14, 1999

(30) Foreign Application Priority Data

Jun. 30, 1997 (IE) ..... S970483

(51) Int. Cl.[7] ..... E04C 2/00

(52) U.S. Cl. ..... 52/232; 52/64; 52/66; 52/266; 52/271; 52/283; 52/243.1

(58) Field of Search ..... 52/232, 64, 262, 52/66, 271, 283, 243.1

(56) References Cited

U.S. PATENT DOCUMENTS 4,583,333 A * 4/1986 Minter ..... 52/90
4,601,143 A * 7/1986 O'Keefe et al. ..... 52/171
6,141,915 A * 11/2000 Andersen et al. ..... 52/219

* cited by examiner

*Primary Examiner*—Carl D. Friedman
*Assistant Examiner*—Chi Nguyen
(74) *Attorney, Agent, or Firm*—Kilpratick Stockton, LLP

(57) ABSTRACT

A fire-retardant roof construction in a building wherein a fire-resistant wall separates a first room from a second room and supports purlins which carry a roof cladding fire-retardant roof construction. A first set of parallel purlins extends over the first room, each having one end pivotally mounted over a horizontal axis parallel to the wall adjacent the top of the wall. A set of upright cleats of sheet metal are secured to the top of the wall, each providing the pivotal mounting for a respective purlin. A second set of parallel purlins extends over the second room, and is mounted on cleats in the manner of the first set. The pivotal mountings are so located that each purlin, if deprived of support elsewhere, can collapse to hang down from its pivot without structural damage to the wall or the respective cleat. A first fireproof curtain seals the walltop space between each adjacent pair of purlins of the first set, and a second fireproof curtain seals the walltop space between each adjacent pair of purlins of the second set. The two curtains define between them a sufficient space so that damage to one curtain from collapsing purlins does not breach the other curtain. A divide in the roof cladding directly over the space provides for controlled separation whereby the cladding can collapse together with its supporting purlins over one room without effect on the purlins, or on the cladding supported by the purlins, of the other room.

5 Claims, 6 Drawing Sheets

FIRE-RETARDANT ROOF CONSTRUCTION

TECHNICAL FIELD

This invention relates to roof/wall interface design for fire protection. In particular, it relates to a construction of roof intended for fire protection, and is mainly concerned with industrial and commercial buildings having a structural steel roof framework.

BACKGROUND OF THE INVENTION

The invention is an exercise in structural fire control. It is concerned with preventing fire spread across the top of an internal wall or party wall in the space between said wall and the roof cladding, hereinafter called the walltop space. It is likewise concerned with protecting the structural integrity of the wall adjacent said walltop space in fire conditions.

The walltop space arises from the necessity of laying horizontal beams called purlins across the rooms of a building, supported by said internal walls or party walls and themselves carrying the roof cladding. The wall-plane section of a typical walltop space is a long rectangle defined by the roof cladding (the upper long side), the top of the wall (the lower long side) and a section of a purlin at either end (the two short sides).

It is known to seal the walltop space in fire-controlling manner by cutting or fabricating a curtain from a non-combustible material to fit said space, and disposing the curtain in the space, preferably inside a metallic supporting case, to form a firestop. The supporting case is needed when, as is commonly the case, the chosen non-combustible material is flexible, deformable or non-self supporting. Said material may be manufactured, for example, from spun fibres of volcanic and other rocks, treated with resin and cured to form a loose mat, commonly employed at a thickness of 50 mm and floppy at that thickness when bridging voids of dimensions exceeding about 30×30 cm. The preference for the supporting case arises not only from the last consideration but also to provide protection against damage from wear and tear in the course of building maintenance, services installation and repair, etc.

United Kingdom Patent specification no. GB 2 082 647 discloses a fire barrier for sealing a gap between a dividing wall and a roof of a building for preventing the spread of fire and smoke through the gap. The barrier comprises a body of channel section having side webs for securing the dividing wall. A gasket is secured in a fixing groove so as to abut the tiles to seal a gap. A fire break member is provided to join tiling laths where portions have been removed to prevent the spread of fire. Other fire break members to prevent the spread of fire across other structural members of the building are provided e.g. a channel section interconnects roof ridge portions and includes an internal plate for separating adjacent ends of the ridge portions.

The known walltop space seals are vulnerable, however, in fire conditions, to a hazard known as the fulcrum factor, according to which burning or heat-softened roof structures, especially purlins, collapse pivotally and act as levers to damage portions of the building hitherto unaffected by the fire, including the walltop space seal and adjacent wall portions, thereby opening channels for fire spread.

SUMMARY OF THE INVENTION

The invention seeks to create a roof structure offering effective containment of a fire outbreak occurring thereunder to a space defined by the walls of the room in which the fire started. It also seeks to create a fire-retardant roof structure wherein the danger of fire spread by the fulcrum factor aforesaid is substantially eliminated. A further object of the invention is to provide a roof structure for use in the cold or everyday form, which is continuous and stable, but which is capable of controlled separation in hot form or fire conditions, so as to compartmentalize the building and thus confine the fire.

The invention accordingly provides, in a building wherein a fire-resistant wall separates a first room from a second room and supports purlins which carry a roof cladding, a fire-retardant roof construction which is characterized in that it comprises

- a first set of parallel purlins extending over said first room, each having one of its ends pivotally mounted about a horizontal axis parallel to said wall adjacent the top of the wall;
- a set of upright cleats of sheet metal secured to the top of said wall, each providing the pivotal mounting for a respective purlin as aforesaid;
- a second set of parallel purlins extending over said second room, and mounted on cleats in the manner of the first set;
- the pivotal mountings being so located that each purlin, if deprived of support elsewhere, can collapse to hang down from its pivot without structural damage to the wall or the respective cleat;
- a first respective fireproof curtain sealing the walltop space between each adjacent pair of purlins of the first set;
- a second respective fireproof curtain sealing the walltop space between each adjacent pair of purlins of the second set;
- the two curtains defining between them a sufficient space so that damage to one said curtain from collapsing purlins does not entail any breach of the other curtain; and
- a divide in the roof cladding directly over said space, for controlled separation whereby the cladding can collapse together with its supporting purlins over one said room without effect on the purlins, or on the cladding supported by the purlins, of the other room.

In the specification, the word "room" is to be construed to include the situation where the "room" is a unit or bay in separate buildings as in industrial or commercial applications.

Preferably each cleat extends across the walltop to support two purlin ends, one in each room, on respective pivots. Thus the two sets of cleats referred to above are reduced, for preference, to a single set of double cleats.

End portions of a double cleat may, if desired, be offset mutually and united by a medial bridging member to increase the rigidity of the cleat. In that case the purlin ends are applied to opposite faces of the cleat.

Preferably the walltop space is additionally closed off in one or both rooms by a first decorative, and optionally fire resistant, wall cladding panel. Where the walltop is surmounted by a structural I-beam as is often the case, bridging members can be inserted between the flanges of the beam to present a rear edge to the beam web and a front edge, capable of accepting nails or screws, for application of a second wall cladding panel in addition. In fire conditions, the said first wall cladding panel will collapse with the failure of the adjacent purlins, but the said second wall cladding panel should not be affected, and will preserve the I-beam from the worst effects of the fire.

The invention will be understood in greater detail from the following description of a particular and preferred embodiment thereof, given by way of example only, with reference to the accompanying drawings, in which

DETAILED DESCRIPTION OF THE DISCLOSED EMBODIMENT

Figure 1:
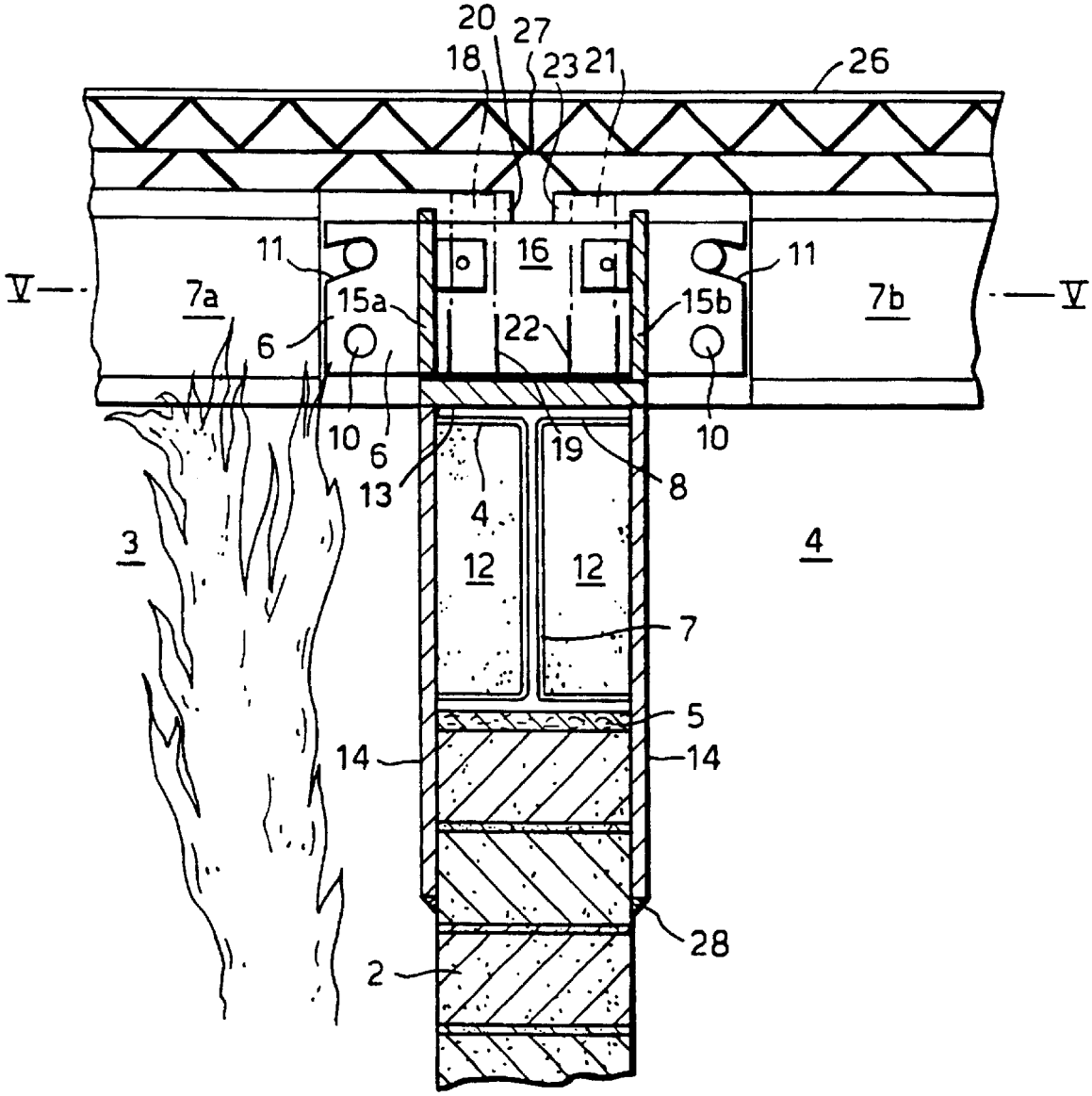
FIG. 1 is a cross-section through the top of an interior wall of a building designed with a roof construction according to the invention.

Referring now to the drawings, a commercial building has a structural steel skeleton which includes a horizontally disposed I-beam 1. A fire resistant masonry wall 2 has been built directly below the beam 1, defining rooms 3 and 4. The top of the wall 2 is sealed to the underside of the bottom flanges of the beam 1 by a 30 mm mineral wool gasket 5.

A plurality of cleats 6 is provided for supporting purlins 7*a* above room 3 and purlins 7*b* above room 4. Each cleat 6 is secured to the upper flanges 8 of the beam 1 by conventional fastening means 9.

Each cleat 6, from its anchorage at 9, extends upwardly and outwardly towards rooms 3 and 4 to provide pivot holes 10 and curved guide slots 11. A bolt passed through a pivot hole 10 and a corresponding hole in the purlin 7*a* or 7*b*, and secured with a nut, serves as a protective pivot pin for the purlin. Another hole in the purlin takes a bolt passing through the guide slot 11 and loosely secured with a nut to promote stability of the purlin in a vertical plane while permitting pivotal collapse thereof in case of fire.

Figure 2:
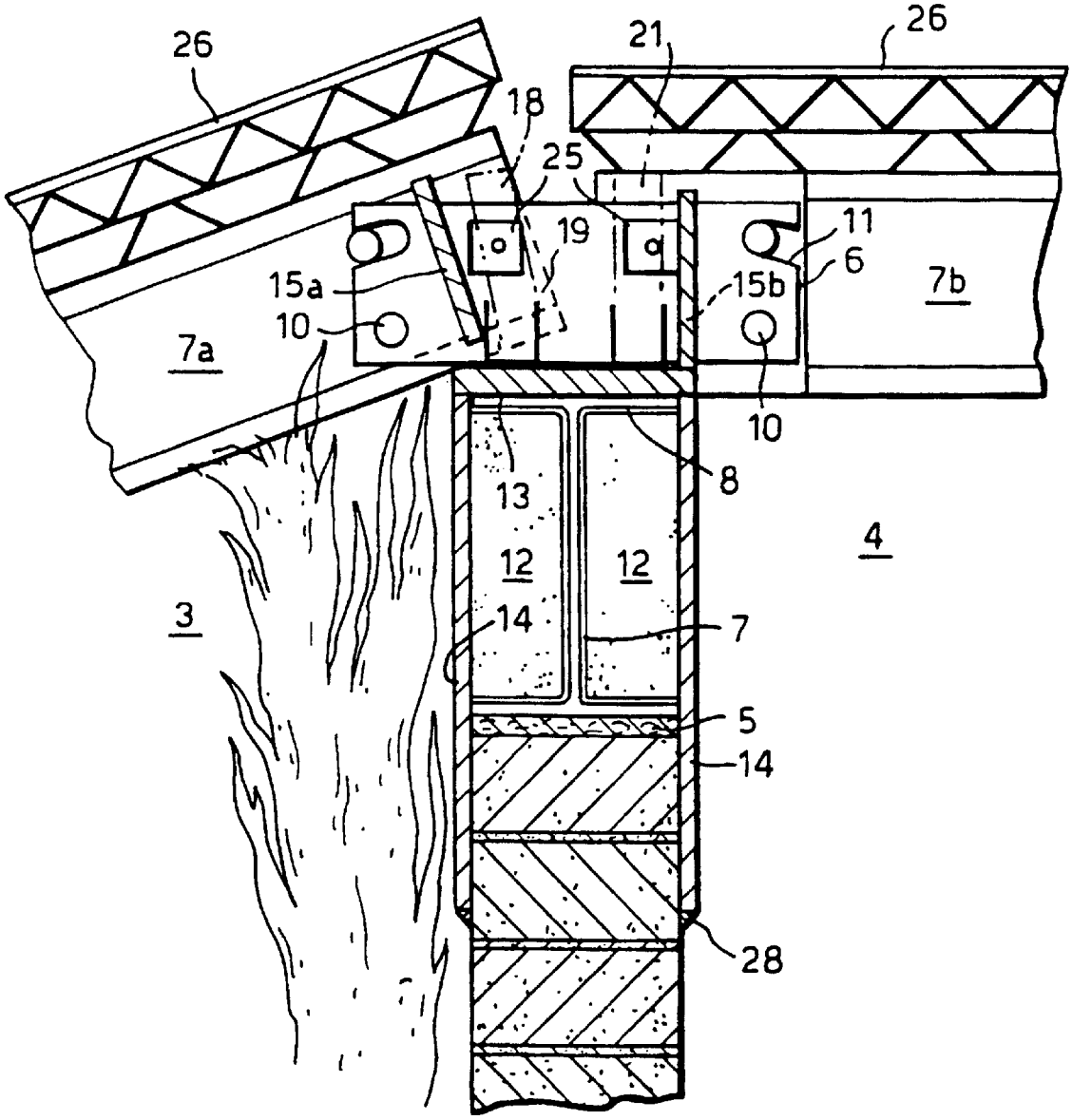
FIGS. 2–4 are cross-sections corresponding to FIG. 1 showing conditions during successive stages of a fire outbreak in the building.
Figure 3:
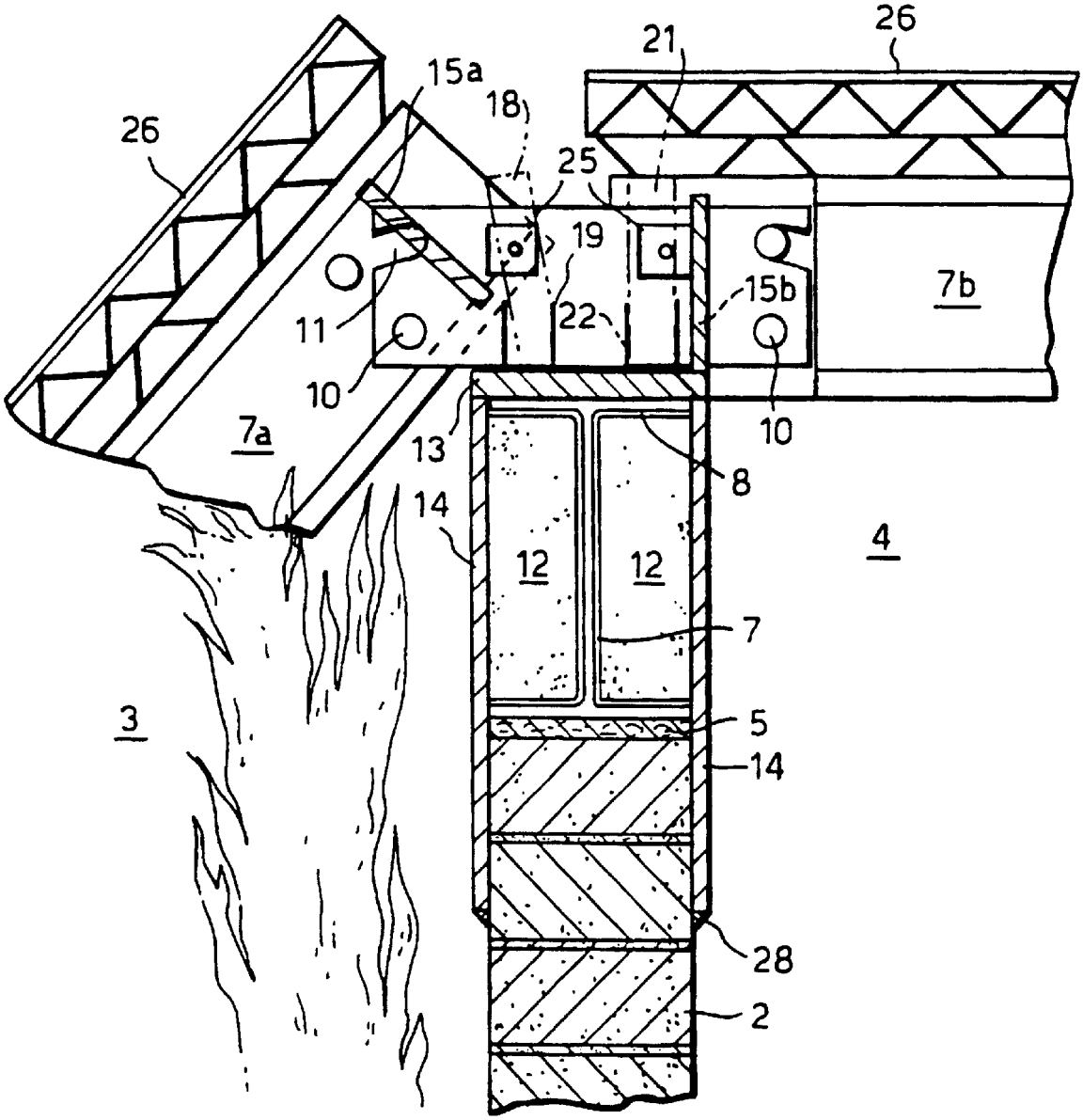
Figure 4:
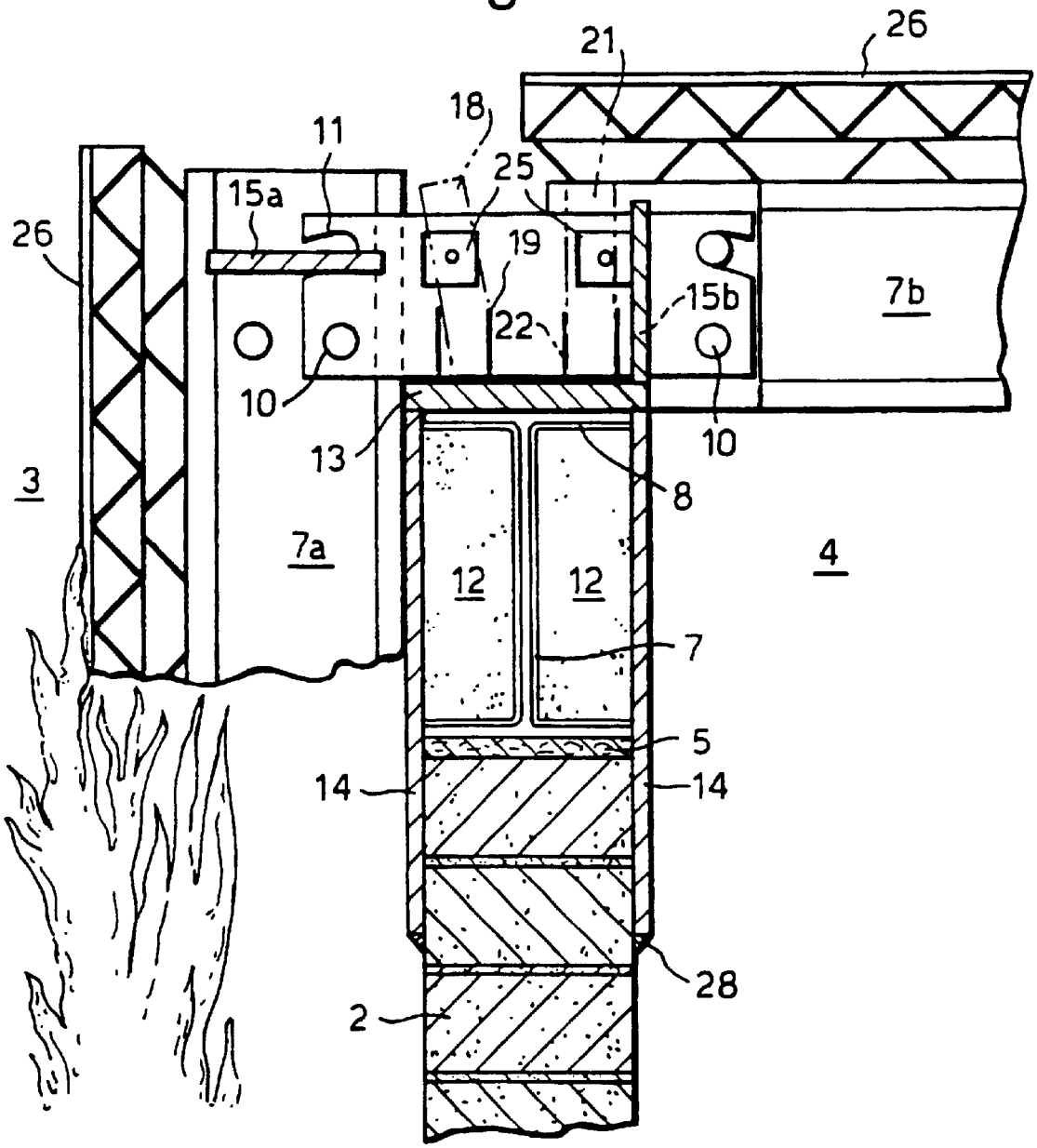
Figure 5:
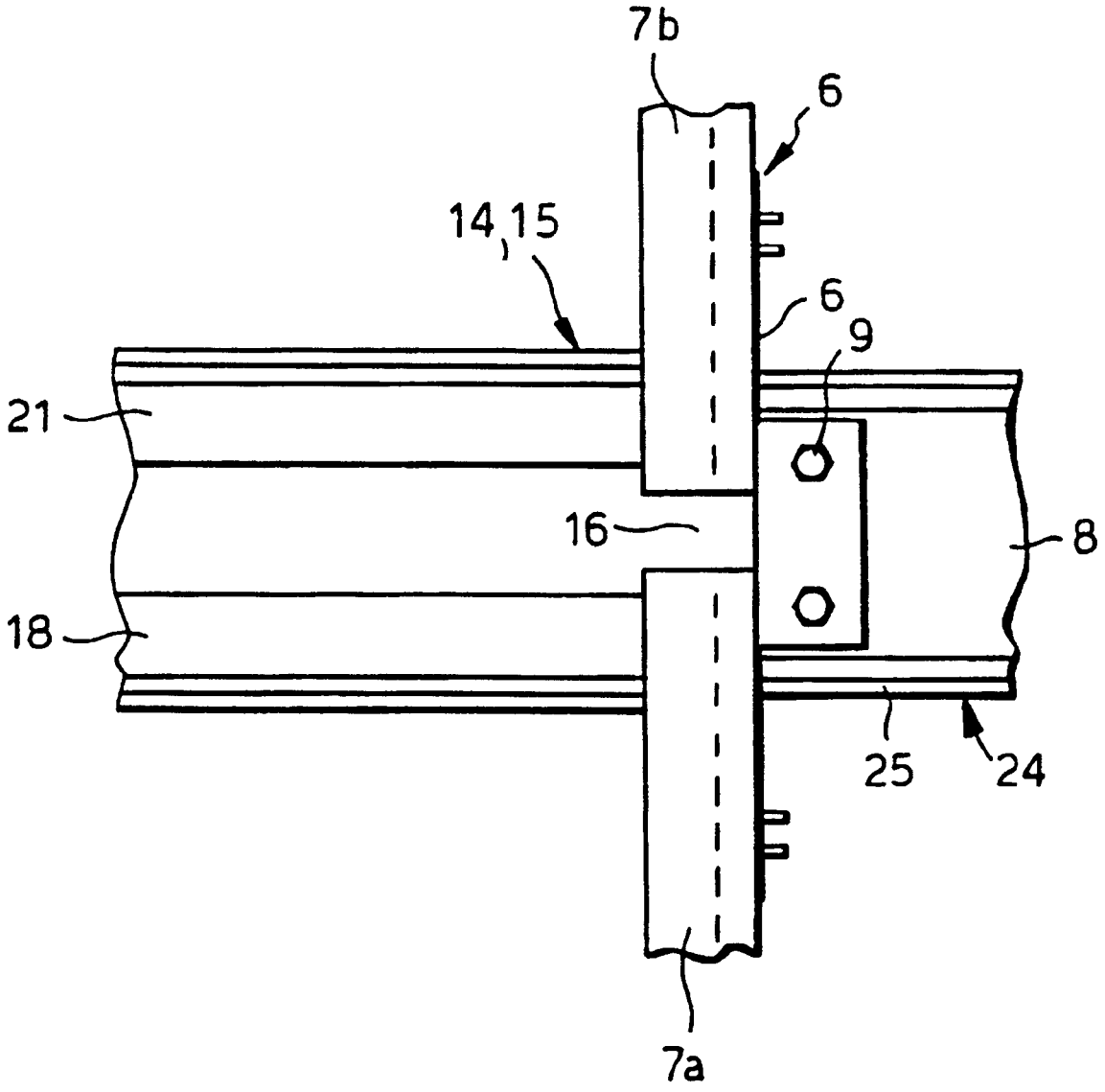
FIG. 5 is a plan view of the structures shown in FIG. 1, taken along the line (or plane) V—V in that figure.

Bridging members 12 are press-fitted, glued or cemented into the channel of the I-beam at 500 mm centers (on both sides) and may be of a material which will accept and retain nails or screws. A mounting member 13 of similar material is placed on the top flanges of the I-beam 1. A fire-resistant (1 to 4 hours) and decorative panel or panelling 14 is applied to the surface of the wall 2 and secured by nails, screws or adhesive means to the exposed edges of members 12 and 13 to protect the I-beam 1 against fire. It is finished at its lower edge by an intumescent mastic seal 28 to the wall 2. An upper fire-resistant panel or panelling 15*a* (15*b*) is mounted between adjacent purlins 7*a* (7*b*) but exercises a mainly decorative role, since it comes away with a collapsing purlin or purlins (e.g. 7*a* as shown in FIGS. 2–4). The panelling 14 however is preserved being physically separate from the panelling 15*a*, 15*b*.

A 50 mm gap 16 is preserved between adjacent ends of purlins 7*a* and 7*b*.

Figure 6:
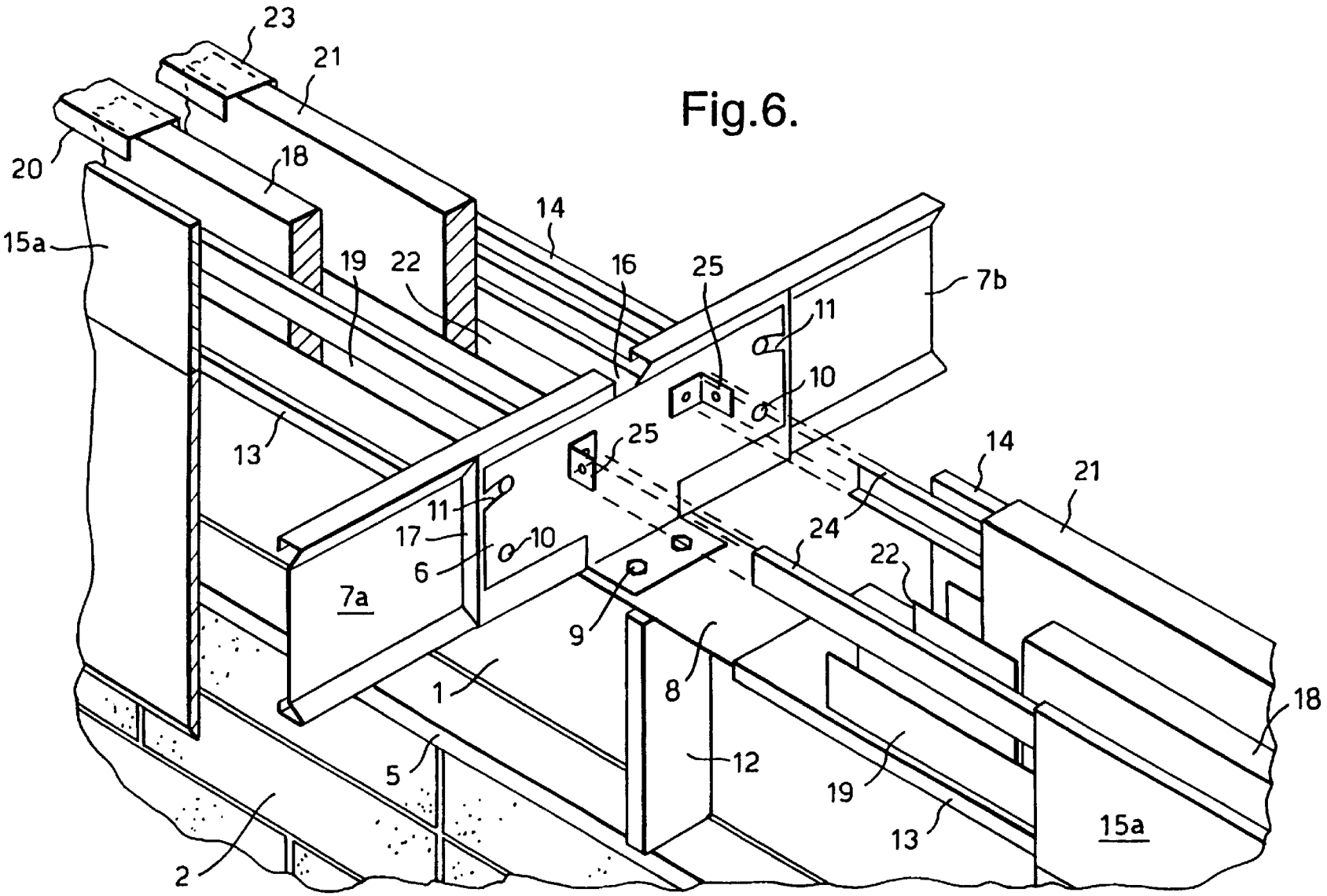
FIG. 6 is a partly cut-away perspective view of the structures shown in FIG. 1, except that the roof cladding shown in that figure has been omitted.

A 50 mm thick mineral wool "cockscomb" or fireproof curtain 18 stands in a metal U-channel 19 mounted on the mounting member 13, extends upwards to a similar, inverted U-channel 20 (FIG. 6) and extends at either end to fire-sealing engagement with a respective purlin 7*a*, thus creating by repetition a first fireproof curtain for the entire length of the wall A second, similar 50 mm thick mineral wool "cockscomb" or fireproof curtain 21 stands in a second, parallel U-channel 22 likewise mounted on the mounting member 13, spaced apart 50 mm from the U-channel 19. It extends upwards to a second inverted U-channel 23 and extends at either end to fire-sealing engagement with a respective purlin 7*b*, thus creating by repetition a second fireproof curtain for the entire length of the wall 2, spaced apart 50 mm from the first said fire curtain.

Side channels 24 of shallow U-shaped cross-section are secured to brackets 25 upstanding from the cleats 6 and serve to enclose and support the mineral wool cockscombs 18, 21 intermediate their base and top. They also serve as a ground for mounting the panelling 15*a*, 15*b*(e.g. with self-tapping screws) in addition to the mounting member 13 to which said panelling is secured (e.g. by nails).

The roof cladding 26 is divided at 27, which reference number designates a line in the median plane of the wall 2, directly above the 50 mm gap 16. A weather trim strip preferably masks the divide but does not impede the unilateral collapse of the cladding together with the purlins to which it is attached on one side (e.g. in room 3) of the wall 2, while the purlins and cladding on the other side of said wall (e.g. in room 4) have their integrity preserved.

It will be appreciated that the invention embodies some of the principles of rational structural fire control, whereby buildings intended for use in the "cold form" are adapted to compartmentalize them for structural integrity of each resulting compartment in the "hot form" created by a fire, whereby to prevent the spread of the fire from one said compartment to the next, at least for such time as is needed for the deployment of conventional fire-fighting teams and equipment.

What is claimed is:

1. A fire-retardant roof construction provided in a building wherein a fire-retardant wall (2) separates a first room (3) from a second room (4) and supports purlins which carry a roof cladding (26), the fire retardant roof construction being characterized in that it comprises a first set of parallel purlins (7*a*) extending over said first room (3);

a first set of upright cleats (6) secured to the top of said wall (2), each of said first set of purlins (7*a*) having an end pivotally mounted to a corresponding one of said first set of upright cleats (6) about a horizontal axis parallel to said wall adjacent the top of said wall;

a second set of parallel purlins (7*b*) extended over said second room (4);

a second set of upright cleats (6) secured to the top of said wall (2), each of said second set of purlins (7*b*) having an end pivotally mounted to a corresponding one of said second set of upright cleats (6) about a horizontal axis parallel to said wall adjacent the top of said wall;

the pivotal mountings being so located that each purlin (7*a*, 7*b*) can collapse to hang down from its pivot (9) without structural damage to the wall (2) or the respective cleat (6);

a first respective fireproof curtain (18) sealing the walltop space between each adjacent pair of purlins (7*a*) of the first set;

a second respective fireproof curtain (21) sealing the walltop space between each adjacent pair of purlins (7*b*) of the second set;

the two curtains (18, 21) defining between them a sufficient space (16) so that damage to one said curtain (18, 21) from collapsing purlins does not entail any breach of the other curtain; and a divide (27) in the roof cladding directly over said space, for controlled separation whereby the cladding (26) can collapse together with its supporting purlins over one of said room (3, 4) without effect on the purlins, or on the cladding supported by the purlins, of the other of said rooms (3, 4).

2. A fire-retardant roof construction as claimed in claim 1 wherein each cleat (6) extends across the walltop to support two purlin ends (7*a*, 7*b*), one in each room, on respective pivots whereby a single set of double cleats is provided.

3. A fire retardant roof construction as claimed in claim 2 wherein end portions of a double cleat are offset mutually and united by a medial bridging member to increase the rigidity of the cleat, whereby the purlin ends are applied to opposite faces of the cleat.

4. A fire-retardant roof construction as claimed in claim 1 further comprising a decorative, and optionally fire-resistant, wall cladding panel (15*a*, 15*b*) disposed to close off said walltop space in at least one of said rooms (3, 4).

5. A fire-retardant roof construction as claimed in claim 1 wherein the walltop is surmounted by a structural I-beam (1), bridging members (12) are inserted between the flanges of the beam (1) to present a rear edge to the beam web and a front edge, capable of accepting nails or screws, for application of a second wall cladding panel; in addition whereby in fire conditions, said first wall cladding panel (15*a*, 15*b*) will collapse with the failure of the adjacent purlins, but said second wall cladding panel (14) should not be affected and will preserve the I-beam from the worst effects of the fire.

* * * * *